US007954212B2

(12) United States Patent
Funo et al.

(10) Patent No.: US 7,954,212 B2
(45) Date of Patent: Jun. 7, 2011

(54) SHEET ATTACHING INSTRUMENT

(75) Inventors: Yasuaki Funo, Taipei (TW); Natsuko Saitsu, Kurobe (JP)

(73) Assignee: YKK Corporation, Tokyo (JP)

( * ) Notice: Subject to any disclaimer, the term of this patent is extended or adjusted under 35 U.S.C. 154(b) by 791 days.

(21) Appl. No.: 11/978,746

(22) Filed: Oct. 30, 2007

(65) Prior Publication Data

US 2008/0115346 A1 May 22, 2008

(30) Foreign Application Priority Data

Nov. 17, 2006 (JP) ..... 2006-311346

(51) Int. Cl.
*A44B 11/25* (2006.01)

(52) U.S. Cl. ..... 24/682.1; 24/625

(58) Field of Classification Search ..... 24/614–616, 24/625, 265 BC, 265 EC, 682.1, 685, 686, 24/689, 684, 696
See application file for complete search history.

(56) References Cited

U.S. PATENT DOCUMENTS

| | | | | |
|---|---|---|---|---|
| 3,120,971 | A * | 2/1964 | Walter | 292/91 |
| 4,815,175 | A * | 3/1989 | Kasai | 24/193 |
| 6,510,592 | B1 | 1/2003 | Hamilton | |
| 6,622,355 | B2 | 9/2003 | Buscart et al. | |
| 7,194,787 | B2 | 3/2007 | Murai et al. | |
| 2003/0217441 | A1 | 11/2003 | Eaton et al. | |
| 2004/0226149 | A1 | 11/2004 | Murai et al. | |

FOREIGN PATENT DOCUMENTS

| | | |
|---|---|---|
| CN | 15506167 | 12/2004 |
| EP | 1477079 | 11/2004 |
| JP | 2004-329736 | 11/2004 |
| JP | 2006-204638 | 8/2006 |
| KR | 2004-0097919 | 11/2004 |

OTHER PUBLICATIONS

Office Action dated Mar. 31, 2010, for Taiwanese Patent Application No. 96141620.
Translation of Office Action for corresponding Chinese Application No. 200710168109.6 issued Feb. 20, 2009.
Translation of Korean Search Report dated Jan. 28, 2009 for corresponding Korean Patent Application No. 116045/2007.

* cited by examiner

*Primary Examiner* — James R Brittain
(74) *Attorney, Agent, or Firm* — Alston & Bird LLP

(57) ABSTRACT

The sheet attaching instrument includes an instrument body 12 and a fixing member 14 fixing the instrument body 12 to a sheet 1. The instrument body 12 has a first projection 20 and a second projection 30. The first projection 20 has a first shaft 21 and a first holding flange 22 extending from a tip end of the first shaft 21, while the second projection 30 has a second shaft 31 and a second holding flange 32 provided on a tip end of the second shaft 31. The fixing member 14 includes a first engaging portion 40 adapted to be engaged with the first projection 20 and a second engaging portion 50 adapted to be engaged with the second projection 30. After the first engaging portion 40 is slid relative to the first projection 20 for the engagement, the fixing member 14 is rotated with the first projection 20 as support point in a direction of approaching the instrument body 12. Then the second engaging portion 50 is engaged with the second projection 30.

6 Claims, 6 Drawing Sheets

SHEET ATTACHING INSTRUMENT

BACKGROUND OF THE INVENTION

1. Field of the Invention

The present invention relates to a sheet attaching instrument. More particularly, the invention relates to an instrument for attaching a belt or tape, etc. to sheet products such as clothes, bags, and covers directly or via a buckle, a magnet catch, a belt adjuster, a clasp, a tape stopper, a code stopper, or the like.

2. Description of Related Art

Clothes, bags, covers and the like have been manufactured mainly from woven clothes and synthetic-resin sheets etc. In these sheet products, a buckle, a magnet catch or the like is attached for opening and closing a lid thereof, and a belt, a tape or the like is attached as a grip for carrying.

For instance, in order to close a flap for shutting an opening of a bag, a plug of a buckle is attached to a tip end of the flap and a socket into which the plug is inserted to be held therein is attached to a front surface of the bag.

To realize such attachment, an arrangement has been employed in which a socket body or a plug body is arranged on a front surface of a sheet and a fixing member is arranged on a back surface of the sheet, such that the fixing member fixes the socket body or the plug body to the sheet (See, Document 1; U.S. Pat. No. 6,622,355, FIGS. 1 and 3).

In the structure shown in FIG. 1 of the Document 1, four projections are provided integrally on the fixing member to protrude therefrom and four engaging holes are formed on the socket to be engaged with the four projections.

In order for the socket to be fixed on the sheet, the fixing member is arranged on the back surface of the sheet, each of the projections penetrates the sheet to protrude from the front surface of the sheet, and the four projections that have protruded from the front surface of the sheet are fitted into the four engaging holes of the socket.

In the structure shown in FIG. 3 of the Document 1, three projections are provided integrally on the socket in a protruding manner and four engaging holes are formed on the fixing member to be engaged with the projections. Each of the projections includes a shaft protruding from the socket and a holding portion extending in a predetermined direction from the shaft. Each of the engaging holes includes: an insertion groove into which each projection is inserted; and an engagement groove formed in a predetermined direction from the insertion groove so as to be engaged with each projection.

In order for the socket to be fixed on the sheet, the socket is arranged on the front surface of the sheet, each of the projections penetrates the sheet to protrude from the back surface of the sheet, and the projections that have protruded from the back surface of the sheet are respectively inserted into three of the insertion grooves of the fixing member. Thereafter, the fixing member is slid. Consequently, the three projections are held by the three engagement holes.

SUMMARY OF THE INVENTION

The both examples described above employ a structure where the plurality of projections are simultaneously fitted into the plurality of engaging holes. Thus, when the fitting operation is performed while the socket and the fixing member are not parallel with each other, i.e., in an inclined posture, the fitting of the plurality of projections into the plurality of engaging holes is rendered difficult.

Particularly in the latter case (i.e., where the fixing member is slid after the projections are inserted into the three engagement grooves of the fixing member), when the front surface (back surface) of the sheet is rough and made of a hard material, a large resistance is applied to the sliding of the fixing member, and the sliding operation can not be easily performed.

An object of the present invention is to solve such a problem as described above and to provide a sheet attaching instrument that can reliably and easily fix an instrument body to a sheet.

A sheet attaching instrument according to an aspect of the present invention is a sheet attaching instrument having: an instrument body 12 attached to a front surface of a sheet 1; and a fixing member 14 arranged on a back surface of the sheet 1 to fix the instrument body 12 to the sheet 1, in which the instrument body 12 includes: a first projection 20; and a second projection 30 penetrating the sheet 1, the first projection 20 and the second projection 30 provided on a surface contacting the sheet 1 to be apart from each other, the fixing member 14 includes: a first engaging portion 40 adapted to be engaged with the first projection 20; and a second engaging portion 50 adapted to be engaged with the second projection 30, the first engaging portion 40 allowing one of the instrument body 12 and the fixing member 14 to be rotated with the first projection being a support point in a direction of approaching the other, the second engaging portion 50 being engageable with the second projection 30 when the instrument body 12 and the fixing member 14 approach each other, and the second engaging portion 50 has an insertion hole 51 into which the second projection 30 is inserted, the insertion hole 51 being engaged with the second projection 30.

According to this aspect, the instrument body is arranged on the front surface of the sheet and the first and second projections of the instrument body protrude from the back surface of the sheet. In this state, the first projection having protruded from the back surface of the sheet is engaged with the first engaging portion of the fixing member. Then, with the first projection of the instrument body being the support point, the instrument body and the fixing member are rotated in a direction of approaching each other. For example, the fixing member is rotated in a direction of approaching the instrument body, so that the second engaging portion of the fixing member is engaged with the second projection having protruded from the back surface of the sheet. In short, when the fixing portion is rotated, the fixing portion abuts to the second projection. When the fixing portion is further rotated, the second projection is inserted into and engaged with the insertion hole. With this arrangement, the second projection is prevented from disengaging from the insertion hole.

Accordingly, in the present invention, the instrument body can be fixed to the sheet merely by engaging the first projection of the instrument body having protruded from the back surface of the sheet with the first engaging portion of the fixing member, rotating in this state the fixing member in a direction to approach the instrument body with the first projection being the support point, and engaging the second engaging portion of the fixing portion with the second projection having protruded from the back surface of the sheet. In sum, unlike a conventional arrangement, there is no need to maintain the parallel postures of the instrument body and the fixing member such that the instrument body is fitted with the fixing member. Accordingly, the instrument body can be reliably and easily fixed to the sheet.

According to the aspect of the present invention, it is desirable that in the sheet attaching instrument, the first projection 20 includes a first shaft 21 and a first holding flange 22 extending from the first shaft 21 in a predetermined direction, the second projection 30 includes: a second shaft 31 provided to be apart from the first projection 20; and a second holding flange 32 provided on the second shaft 31, the second shaft 31 being provided on a side opposite to an extending direction of the first holding flanges 22, the second holding flange 32 protruding in a direction perpendicular to the predetermined direction, and the second engaging portion 50 includes an elastically deformable portion 53 that is elastically deformed in a direction in which at least a part of the insertion hole 51 is expanded.

According to this aspect, the first projection having protruded from the back surface of the sheet is engaged with the first engaging portion of the fixing member by the first holding flange that extends from the tip end of the first shaft in a predetermined direction, and the second projection having protruded from the back surface of the sheet is engaged with the second engaging portion of the fixing member by the second holding flange that protrudes from the tip end of the second shaft in a direction substantially perpendicular to the predetermined direction. Thus, even when applied with an inclining force, the fixing member or the instrument body is rarely inclined.

For instance, when an inclined force whose axis line is substantially perpendicular to the predetermined direction is applied to the fixing member or the instrument body, the engagement of the first engaging portion with the first holding flange that extends from the tip end of the first shaft in the predetermined direction restricts the inclination of the fixing member or the instrument body. In addition, when an inclined force whose axis line coincides with the predetermined direction is applied to the fixing member or the instrument body, the engagement of the second engaging portion with the second holding flange that protrudes from the tip end of the second shaft in the direction perpendicular to the predetermined direction restricts the inclination of the fixing member or the instrument body. Accordingly, the instrument body can be reliably fixed to the sheet without rattling.

Further, the second engaging portion has an elastically deformable portion that elastically deforms in a direction to expand at least a part of the insertion hole, so that the second holding flange can be easily inserted into the insertion hole and a reliable engagement is realized.

According to the aspect of the present invention, it is desirable that in the sheet attaching instrument, the insertion hole 51 is provided between a pair of elastically deformable members of the elastically deformable portion 53 and adapted to be expanded when the elastically deformable members of the elastically deformable portion 53 are deformed in a direction to be apart from each other, the insertion hole 51 including a projecting part 55 that protrudes from at least one of the elastically deformable members toward the other elastically deformable member of the elastically deformable portion 53, and the projecting part 55 is provided to face the second shaft 31 of the second projection 30, the projecting part 55 being provided at a surface opposite to the extending direction of the first holding flange 22.

According to this aspect, when such a force is applied to the instrument body as to slide the instrument body in one of predetermined directions in relation to the fixing member, the engagement of the first projection with the first engaging portion restricts the sliding of the instrument body. In addition, when such a force is applied to the instrument body as to slide the instrument body in the other predetermined direction in relation to the fixing member, the second shaft of the second projection abuts the projecting part to restrict the sliding of the instrument body. Therefore, the sliding of the instrument body in both of the predetermined directions can be restricted. Specifically, when the instrument body is, for example, a socket of a buckle and a force in the insertion or pull-out direction of the plug is applied to the socket, the shifting of the socket from the sheet can be prevented.

According to the aspect of the present invention, it is desirable that in the sheet engaging instrument, the second engaging portion 50 has a holding portion 52 around the insertion hole 51, the holding portion 52 adapted to hold the second holding flange 32, and the elastically deformable portion 53 is elastically deformed in a direction perpendicular to the predetermined direction, such that the insertion hole 51 is expanded.

With this arrangement, the second flange can be easily inserted into the insertion hole, thereby realizing a reliable engagement.

DETAILED DESCRIPTION OF PREFERRED EMBODIMENT(S)

An embodiment of the present invention will be described below with reference to the attached drawings.

[Overall Arrangement]

Figure 1:
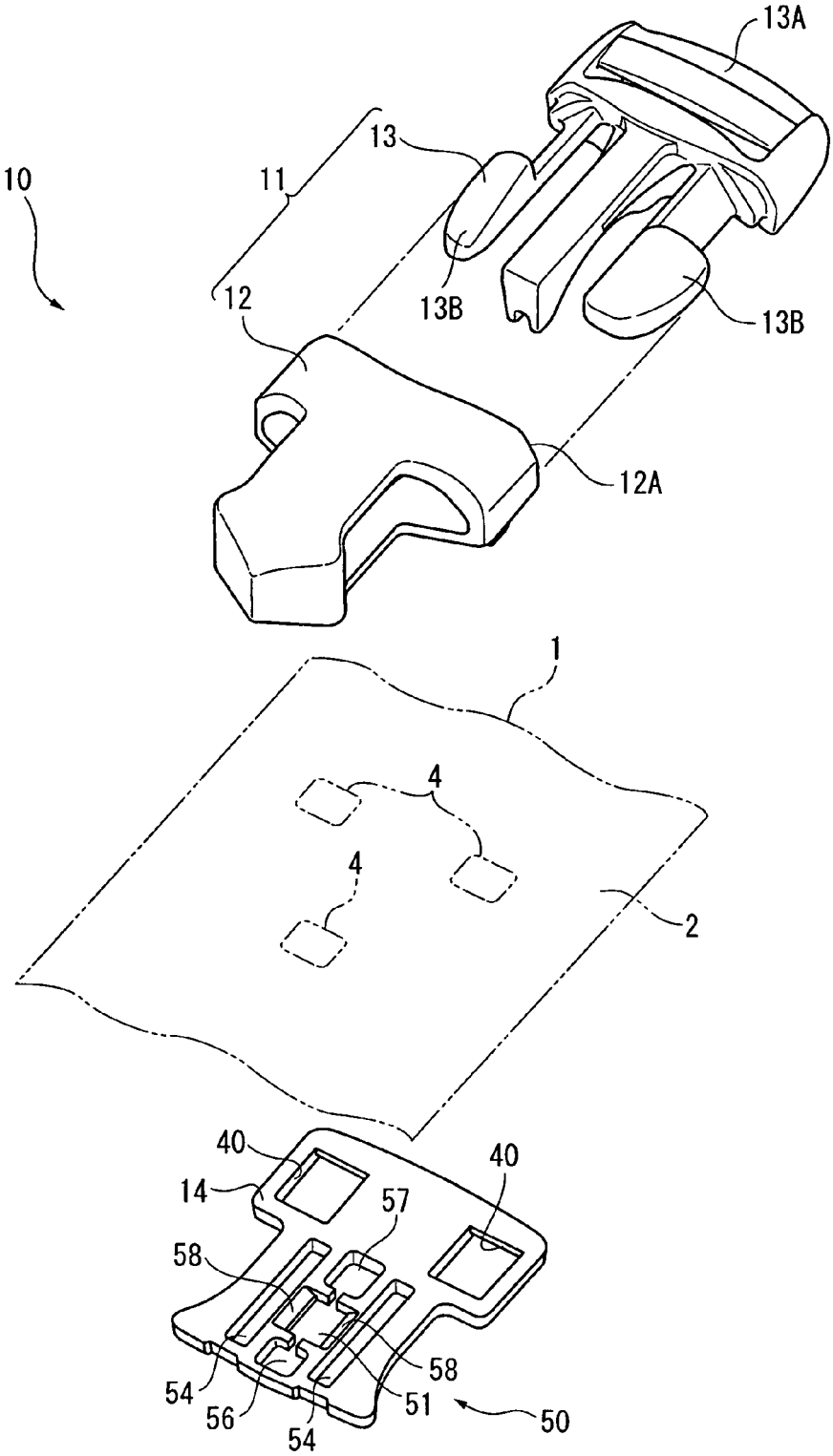
FIG. 1 is an exploded perspective view for explaining an embodiment of the present invention.
Figure 2:
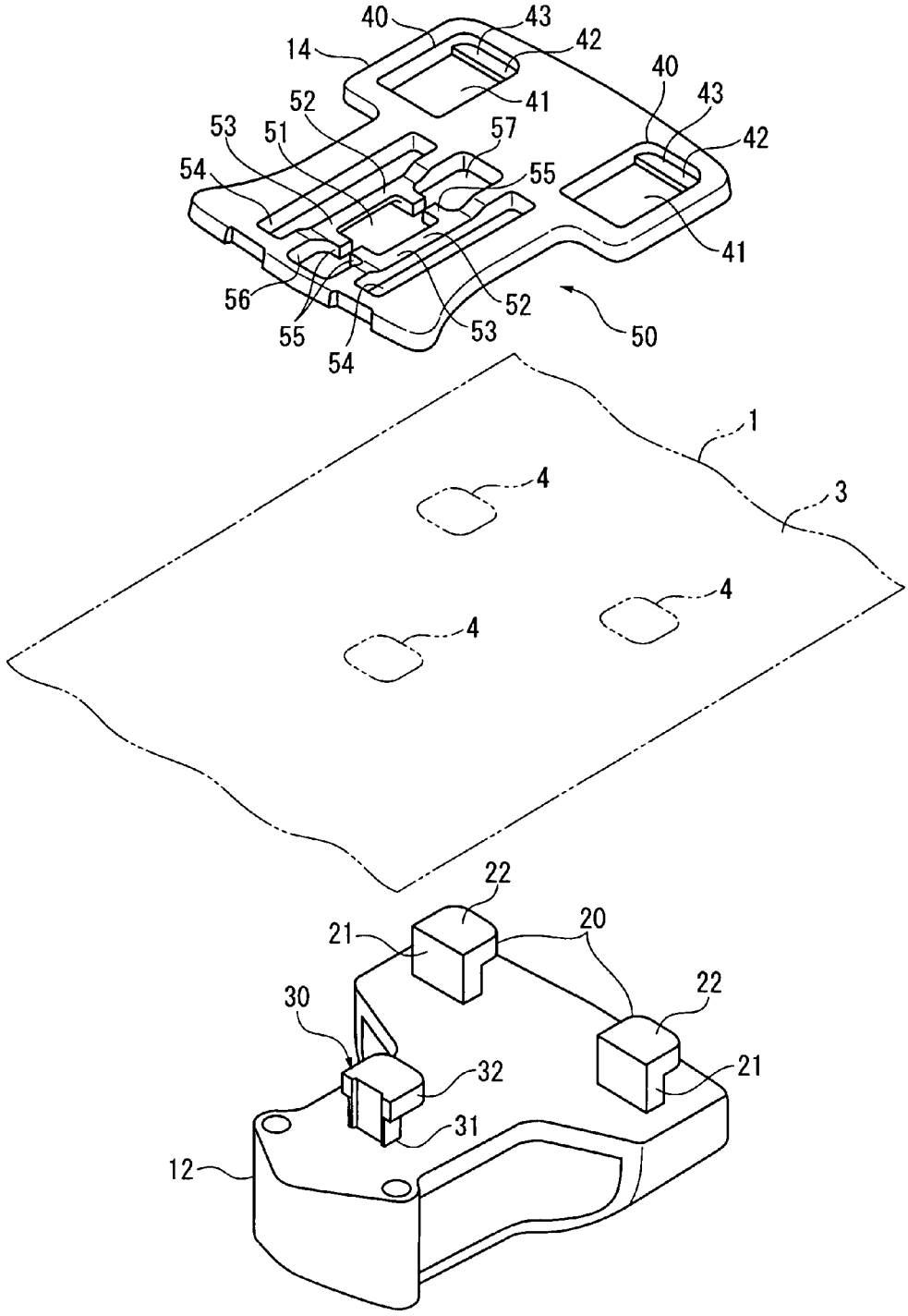
FIG. 2 is an exploded perspective view showing the sheet attaching instrument seen from a back surface according to the embodiment.

FIG. 1 is an exploded perspective view showing a sheet attaching instrument 10 according to the present embodiment, and FIG. 2 is an exploded perspective view showing the sheet attaching instrument 10 seen from a back surface according to the present embodiment.

As shown in these figures, the sheet attaching instrument 10 according to the present invention includes an instrument body 12 as a socket of a buckle 11 and a fixing member 14 fixing the instrument body to sheet 1. The buckle 11 includes the socket 12 (instrument body) and a plug 13. Note that these components are formed by resin injection molding.

The sheet 1 is, for example, a front cloth for a bag. The instrument body 12 is arranged on a front surface 2 while the fixing member 14 is arranged on a back surface 3.

In the sheet 1, holes 4 for coupling the instrument body 12 and the fixing member 14 are formed on a section to which the sheet attaching instrument 10 is attached. The holes 4 are formed according to a layout pattern in which the number and the positions of the holes 4 correspond to those of below-described first and second projections 20, 30 of the instrument body 12 and first and second engaging portions 40, 50 of the fixing member 14.

The instrument body 12 is the socket of the buckle 11 and can be coupled with and decoupled from the plug 13 of the buckle 11. The plug 13 has: a belt attachment 13A on which a belt is attachable; and a pair of engaging arms 13B protruding from the belt attachment 13A to engage with the socket (instrument body 12). The socket (instrument body 12) is formed in a tubular shape and has a plug insert opening 12A to accept the insertion of the engaging arms 13B into the socket (instrument body 12). A direction in which the plug 13 is inserted into the socket (instrument body 12) is defined as an insertion direction and the direction opposite thereto is defined as a pull-out direction. A direction perpendicular to the insertion and pull-out direction on a plane parallel to the sheet 1 is defined as a width direction.

In the instrument body 12, two first projections 20 are provided on a back surface of the instrument body 12 (i.e., the surface contacting the front surface 2 of the sheet 1) with a space interposed between each other in the width direction. A second projection 30 is also provided at a position to be apart from these first projections 20 along a predetermined direction (i.e., the insertion and pull-out direction of the plug 13). These first and second projections 20, 30 protrude from the front surface 2 to the back surface 3 through the holes 4 to be engaged with the first and second engaging portions 40, 50 of the fixing member 14.

The first projections 20 are arranged in pair on the plug insert opening 12A side of the instrument body 12 that accepts the insertion of the plug 13 (right upper side in FIGS. 1 and 2).

The first projection 20 has a first shaft 21 and a first holding flange 22. The first shaft 21 having a rectangular cross-section erects from the back surface of the instrument body 12 to penetrate the sheet 1. The first holding flange 22 having the same width dimension as the first shaft 21 extends from the tip end of the first shaft 21 in a direction toward a front side (i.e., in a direction toward the plug insertion opening 12A side) in a protruding manner. In short, the first projections 20 protrude from the back surface of the instrument body 12 to form an L shape.

The second projection 30 is arranged singularly at a center position, the center position being opposite to the plug insertion opening 12A of the instrument body 12 (left lower side in FIGS. 1 and 2). Specifically, the two first projections 20 and the one second projection 30 are arranged so that lines connecting the first and second projections substantially form a triangle. The predetermined direction described above is also a direction that is perpendicular to the line connecting the two first projections 20 and that passes through the second projection 30. In other words, the second projection 30 is provided on a side opposite to the direction in which the first holding flanges 22 protrude from the first shaft 21.

The second projection 30 includes: a second shaft 31 having a rectangular cross-section; and a second holding flange 32 provided on a tip end of the second shaft 31. The second shaft 31 erects from the back surface of the instrument body 12 and penetrates the sheet 1. The second holding flange 32 has a portion that outwardly protrudes from an outer side surface of the second shaft 31. In short, in the second projection 30, the second holding flange 32 has a portion that protrudes from the outer side surface of the second shaft 31 in the plug insertion direction. The portion also protrudes perpendicularly to the plug insertion direction toward both sides.

The fixing member 14 sandwiches the sheet 1 from the back surface of the instrument body 12 to fix the instrument body 12 to the sheet 1. The fixing member 14 having substantially the same planar shape as the instrument body 12 is basically formed in a thin-plate shape such that the sheet 1 does not become unnecessarily bulky.

The fixing member 14 is provided with: a first engaging portion 40 into which the first projection 20 can be inserted; and a second engaging portion 50 engaged with the second projection 30. In a state where the first projection 20 is inserted, the first engaging portion 40 is slidable in a predetermined direction (plug insertion and pull-out direction) and rotatable with the first projection 20 being a support point in a direction in which the instrument body 12 and the fixing member 14 approach each other.

The first engaging portion 40 is provided in a pair on a front surface of the fixing member 14 (upper right side of FIGS. 1 and 2). Each of the first engaging portions 40 has: an insertion hole 41 into which the first holding flange 22 can be inserted; and a first holding portion 42 formed continuously from the front side (the plug insert opening side in the plug pull-out direction) of the first insertion hole 41. The first insertion hole 41 is slidable relative to the first shaft 21 in the plug insertion and pull-out direction and the first holding portion 42 is engageable with the first holding flange 22.

The first insertion hole 41 has a width dimension slightly larger than that of the first holding flange 22 of the first projection 20 and a length dimension (dimension in the plug insertion and pull-out direction) sufficiently larger than that of the first holding flange 22 of the first projection 20. Accordingly, the instrument body 12 and the fixing member 14 approach each other, such that the first shaft 21 of the first projection 20 can be inserted into the first insertion hole 41. In this state, the instrument body 12 is apart from the fixing member 14, such that the first projection 20 can be freely pulled out from the first insertion hole 41.

The first holding portion 42 is provided with a step portion 43 that is one-step lowered from the surface of the fixing member 14. When the fixing member 14 is moved in a rear direction (the lower left direction in FIGS. 1 and 2) in a state where the first projection 20 is inserted into the first insertion hole 41, the step portion 43 thrusts into under the first holding flange 22. Even if the instrument body 12 is forced to be apart from the fixing member 14 in this state, the first projection 20 cannot be pulled out from the first engaging portion 40. With this arrangement, the first projection 20 is engaged with the first engaging portion 40 with the sheet 1 interposed therebetween. The use of the step portion 43 is advantageous in preventing the tip end of the holding flange 22 from prominently protruding from the fixing member 14. In a case where the holding flange 22 is allowed to protrude, the step portion 43 may not be provided.

The second engaging portion 50 is singularly provided on a rear side of the fixing member 14 (lower left side in FIGS. 1 and 2). The second engaging portion 50 includes: a second insertion hole 51 into which the second shaft 31 can be inserted; a second holding portion 52 enclosing the second insertion hole 51 to be engageable with the second holding flange 32; an elastically deformable portion 53 elastically deformed in a direction that at least a portion of the second insertion hole 51 is expanded to allow the second holding flange 32 to be inserted into the second insertion hole 51; and a deformable operation portion 58 elastically deforming the elastically deformable portion 53 to expand the second insertion hole 51. The deformable operation portion 58 is provided at a position facing the second projection 30 in a state where the first projection 20 is engaged with the first engaging portion 40. When the deformable operation portion 58 is applied with a force in the insertion direction of the second holding flange 32, the deformable operation portion 58 elastically deforms the elastically deformable portion 53.

The elastically deformable portion 53 includes a pair of bridge members spaced from each other. The space between the pair of bridge members defines the second insertion hole 51. The bridge members extend from a front side of the fixing member 14 toward the rear side of the fixing member 14 to be connected to an end of the fixing member 14. A slit 54 penetrating front and back surfaces of the fixing member 14 is formed at a position opposed to the second insertion hole 51 and between the second insertion hole 51 and a contour of the fixing member 14 along the plug insertion and pull-out direction In other words, the elastically deformable portion 53 is defined by the second insertion hole 51 and the slit 54. When the elastically deformable portion 53 is elastically deformed such that a portion of the second insertion hole 51 is expanded, the width of the slit 54 becomes narrow. In addition, since the slit 54 is provided to be parallel to the insertion direction, the elastically deformable portion 53 is elastically deformable in a direction to narrow the slit 54, but not deformable in the insertion direction. The thickness of the elastically deformable portion 53, i.e., the thickness of the bridge member formed between the slit 54 and the second insertion hole 51, is smaller than that of other portions of the fixing member 14.

A projecting part 55 protrudes from each of the bridge members of the elastically deformable portion 53 at two points toward the other bridge member. The second insertion hole 51 is enclosed and defined by the four projecting parts 55 provided on the two bridge members of the elastically deformable portion 53 and the elastically deformable portion 53.

The second insertion hole 51 has a width slightly larger than that of the second shaft 31 of the second projection 30 but smaller than that of second holding flange 32, and has a length dimension larger than that of the second holding flange 32 of the second projection 20. At both front and back surfaces of the second insertion hole 51, a pair of spaces 56, 57 are provided. It is desirable that the dimension of the spaces is made small enough not to allow the first projection 20 and the second projection 30 to fit thereinto. With this arrangement, when assembled, the second projection 30 is prevented from being erroneously inserted into the two spaces 56, 57 in place of the second insertion hole 51. The slit 54 has a length dimension larger than that of the second insertion hole 51, such that the second insertion hole 51 is defined substantially at the center of the slit 54.

In addition, the front two of the four projecting parts 55 may be omitted. In a state where the first engaging portion 40 is engaged with the first projection 20, the rear two projecting parts 55 are provided at a position facing the second shaft 31 of the second projection 30 with a slight gap being held at a surface opposite to an extending direction of the first holding flange 22 (i.e., the rear surface). Specifically, the gap is smaller than an engagement field of the first holding flange 22 with the first holding portion 42. Owing to the gap, even when the first engaging portion 40 of the fixing member 14 slides in a disengagement direction in a state where the instrument body 12 is engaged with the fixing member 14, the rear projecting part 55 abuts to the second shaft 31 to prevent the disengagement. Further, the projecting part 55 may be provided to only one bridge member of the elastically deformable portion 53.

The holding portions 52 are middle portions of the elastically deformable portion 53 that sandwich the second insertion hole 51. The width dimension of the elastically deformable portion 53 is made larger than that of the bi-directionally protruding portion of the second holding flange 32 of the second projection 30.

Figure 7:
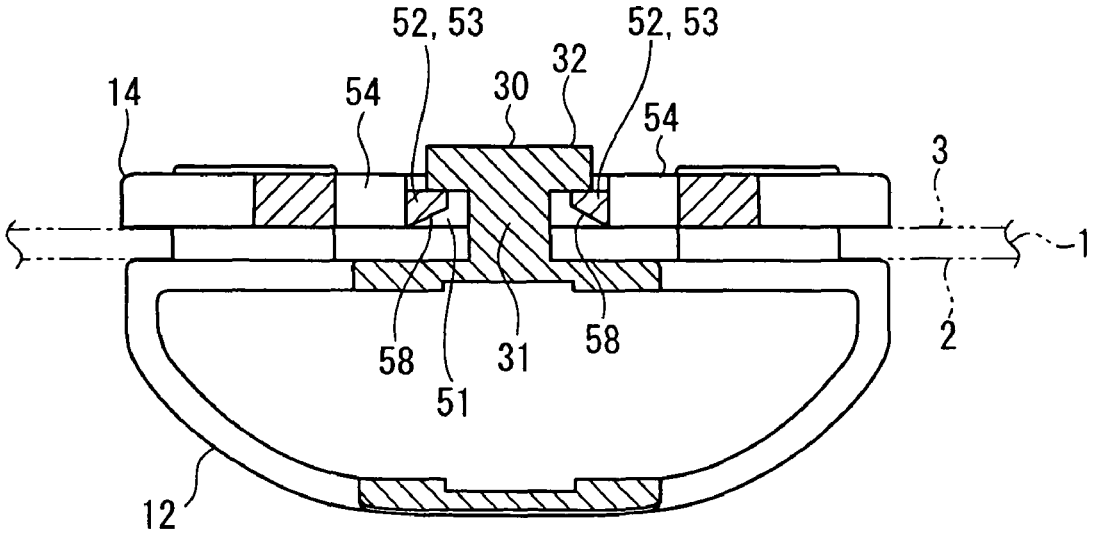
FIG. 7 is a cross-sectional view of the sheet attaching instrument shown in FIG. 5 along the line VII-VII.

As shown in FIGS. 1 and 7, in the elastically deformable portion 53, the deformable operation portion 58 is provided to slope from a position at which the second holding flange 32 abuts on the elastically deformable portion 53 on the sheet 1 side toward the second insertion hole 51. The deformable operation portion 58 is tapered such that the elastically deformable portion 53 gradually reduces the thickness toward the sloping direction of the deformable operation portion 58.

[Attachment Process]

Figure 3:
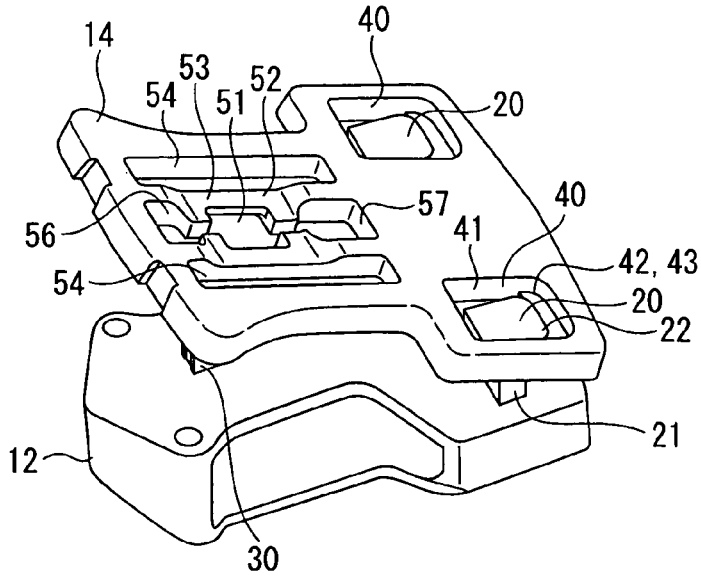
FIG. 3 is a perspective view showing the sheet attaching instrument being assembled according to the embodiment.

The instrument body 12 is arranged on the front surface 2 of the sheet 1 to allow the first projection 20 and the second projection 30 of the instrument body 12 to protrude from the back surface via the holes 4 of the sheet 1. As shown in FIG. 3 (the sheet 1 is not shown), in this state, the first projection 20 having protruded from the back surface of the sheet 1 is engaged with the first engaging portion 40 of the fixing member 14.

For the engagement, the first shaft 21 of the first projection 20 is inserted into the first insertion hole 41 of the first engaging portion 40 and then the fixing member 14 is slid in the plug insertion direction. Subsequently, the step portion 43 thrusts into under the first holding flange 22. In this manner, the first projection 20 is held in the first engaging portion 40.

Figure 4:
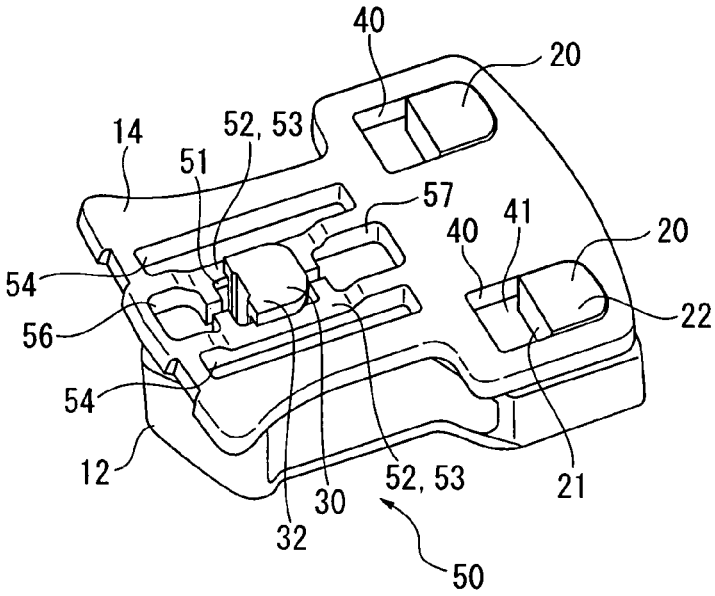
FIG. 4 is a perspective view showing the sheet attaching instrument having been assembled according to the embodiment.

As shown in FIG. 4 (the sheet 1 is not shown), the fixing member 14 is rotated with the first projection 20 being the support point in the direction that the fixing member 14 approaches the instrument body 12 (the direction in which the fixing member 14 becomes parallel to the instrument body 12). The second engaging portion 50 of the fixing member 14 is engaged with the second projection 30 having protruded from the back surface 3 of the sheet 1. As a matter of course, the instrument body 12 may be alternately rotated As the fixing member 14 is rotated, the tapered deformable operation portion 58 of the second engaging portion 50 abuts on the second holding flange 32 of the second projection 30. When the fixing member 14 is further rotated, due to the abutment of the tapered surface of the deformable operation portion 58 on the second holding flange 32, the elastically deformable portion 53 is elastically deformed outwardly, so that the second insertion hole 51 is expanded.

Figure 5:
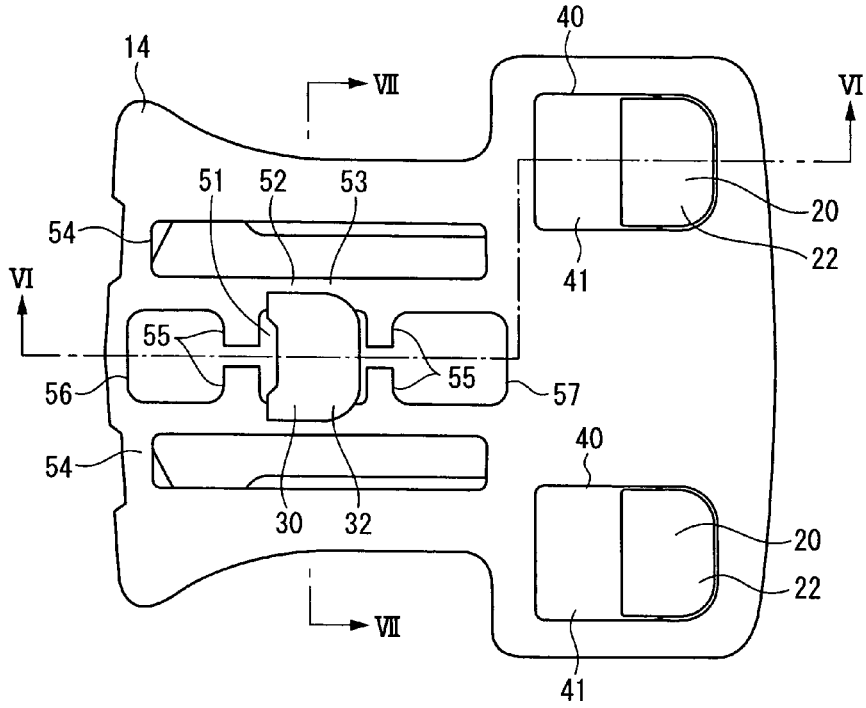
FIG. 5 is a rear elevation view showing the sheet attaching instrument having been assembled according to the embodiment.
Figure 6:
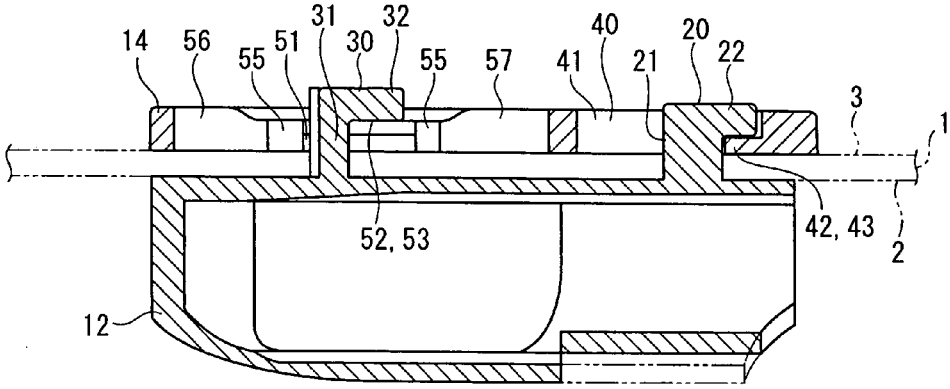
FIG. 6 is a cross-sectional view of the sheet attaching instrument shown in FIG. 5 along the line VI-VI.

The second holding flange 32 is inserted into the second insertion hole 51 of the second engaging portion 50. After the second holding flange 32 passes through the second insertion hole 51 of the second engaging portion 50, the second insertion hole 51 restores its original size. In this manner, the portion of the second holding flange 32 that protrudes outwardly from the outer surface of the second shaft 31 is held by the second holding portion 52, such that the second holding flange 32 is prevented from being pulled out from the second insertion hole 51. In short, as shown in FIGS. 5 to 7, the instrument body 12 is fixed to the surface 2 of the sheet 1 by the fixing member 14.

Advantages of Embodiment (1) The first projection 20 of the instrument body 12 having protruded from the back surface 3 of the sheet 1 is engaged with the first engaging portion of the fixing member 14. In this state, the fixing member 14 is rotated with the first projection 20 being the support point in a direction for the fixing member 14 to be parallel with the instrument body 12. Merely by engaging the second engaging portion 50 of the fixing member 14 with the second projection 30 having protruded from the back surface 3 of the sheet 1, the instrument body 12 can be fixed to the sheet 1. In short, unlike a conventional arrangement, there is no need to maintain the parallel postures of the instrument body 12 and the fixing member 14 so that the fixing member 14 is fitted with the instrument body 12. The fitting of the fixing member 14 with the instrument body 12 is performed by rotating the fixing member 14 to be parallel with the instrument body 12. Thus, the instrument body 12 can be reliably and easily fixed to the sheet 1.

(2) The second holding flange 32 of the second projection 30 has the portion that protrudes from the outer surface of the second shaft 31 toward the front surface, the portion also protruding therefrom in the direction substantially perpendicular to the width direction. In the fixing member 14, the slit 54 is provided between the outer periphery of the second insertion hole 51 and the contour of the fixing member 14 to be substantially parallel with the plug insertion and pull-out direction, and the elastically deformable portion 53 is formed between the slit 54 and the second insertion hole 51. Thus, merely by forming a pair of slits 54 to be parallel with the predetermined direction on the outer periphery of the second insertion hole 51 with the second insertion hole 51 interposed between the slits 54, the elastically deformable portion 53 can be easily provided between the second insertion hole 51 and each of the slits 54.

(3) The projecting part 55 protrudes from each of the elastically deformable portion 53 toward the opposing elastically deformable portion 53, and the space enclosed by the projecting part 55 and the elastically deformable portion 53 is the second insertion hole 51. Thus, the second insertion hole 51 is easily made expandable.

(4) In a state where the first projection 20 is engaged with first engaging portion 40, the projecting parts 55 are provided at positions facing the second shaft 31 of the second projection 30 with the slight gap formed at the surface opposite to the extending direction of the first holding flange 22. Accordingly, when a force is applied to the instrument body 12 in the plug pull-out direction (a direction toward the rear side of the fixing member 14), the engagement of the first projection 20 with the first engaging portion 40 restricts the sliding of the instrument body 12. On the other hand, when a force is applied to the instrument body 12 in the plug insertion direction (a direction toward the front side of the fixing member 14), the second shaft 31 of the second projection 30 abuts on the projecting part 55 to restrict the sliding of the instrument body 12. Thus, it is possible to restrict the sliding in both the directions. In short, the shifting of the instrument body 12 from the sheet 1 can be prevented. In addition, when a force is applied in a direction for the instrument body 12 to be apart from the fixing member 14, the first and second holding portions 42, 52 prevent the disengagement.

(5) The first projection 20 having protruded from the back surface of the sheet 1 is engaged with the first engaging portion 40 of the fixing member 14 by the first holding flange 22 that extends from the tip end of the first shaft 21 in the predetermined direction, and the second projection 30 having protruded from the back surface of the sheet 1 is engaged with the second engaging portion 50 of the fixing member 14 by the second holding flange 32 that protrudes from the tip end of the second shaft 31 in a direction substantially perpendicular to the predetermined direction. Thus, even when applied with an inclining force, the fixing member 14 or the instrument body 12 is rarely inclined.

For instance, when an inclined force whose axis line is substantially perpendicular to the predetermined direction is applied to the fixing member 14 or the instrument body 12, the engagement of the first engaging portion 40 with the first holding flange 22 that extends from the first shaft 21 in the predetermined direction restricts the inclination of the fixing member 14 or the instrument body 12. In addition, when an inclined force whose axis line coincides with the predetermined direction is applied to the fixing member 14 or the instrument body 12, the engagement of the second engaging portion 50 with the second holding flange 32 that protrudes from the tip end of the second shaft 31 in the direction perpendicular to the predetermined direction restricts the inclination of the fixing member 14 or the instrument body 12. Accordingly, the instrument body 12 can be reliably fixed to the sheet 1 without rattling.

[Modifications]

The present invention is not limited to the above described embodiment, but can be implemented in various embodiments including the following modifications.

Figure 8:
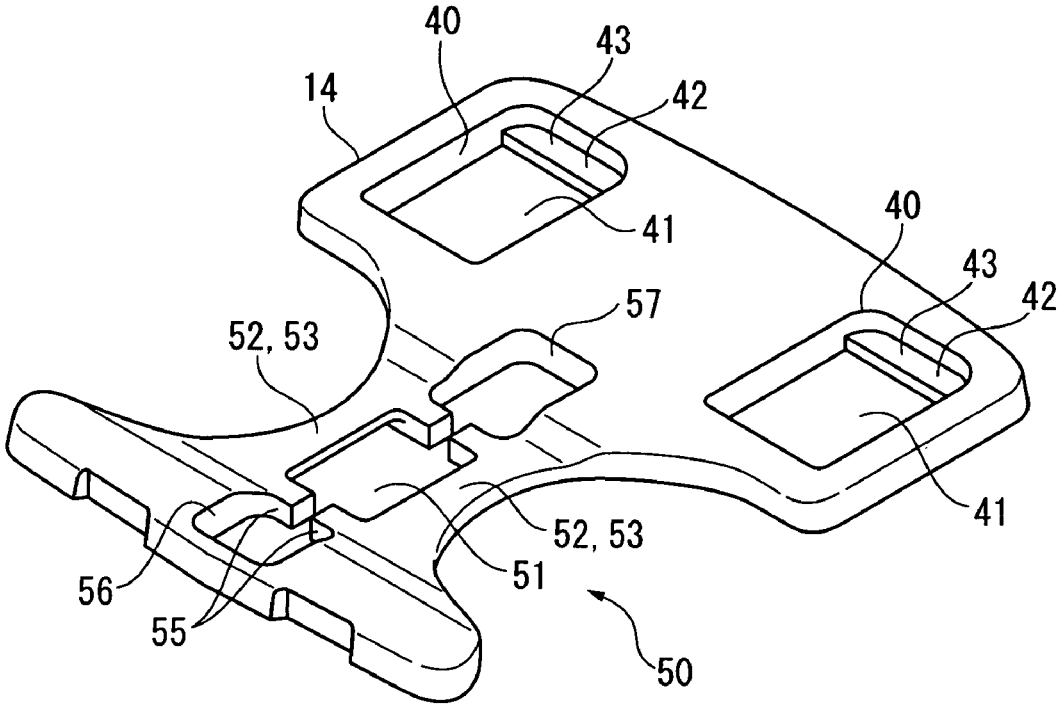
FIG. 8 is a perspective view showing a fixing member according to a modification.

In the above-described embodiment, the pair of slits 54 are provided with the second insertion hole 51 interposed between the slits, and the elastically deformable portion 53 is provided between the slit 54 and the second insertion hole 51. However, the arrangement of the elastically deformable portion 53 is not limited thereto. As shown in FIG. 8, for example, in the second engaging portion 50, both the lateral peripheries in the width direction of the fixing member 14 is circularly cut off inwardly such that both the lateral peripheries in the width direction of the fixing member 14 approach each other from a middle portion of the fixing member toward a rear portion of the fixing member (and departs from each other thereafter). A pair of bridge portions are provided in a narrow shape with the second insertion hole 51 interposed between the portions. With this arrangement, a similar advantage can be obtained. Particularly, in such an arrangement, there is no need to form the slit 54. Thus, a molding die can be simplified.

Additionally, instead of expanding the second insertion hole 51 using the elastically deformable portion 53, the second projection 30 may be elastically deformed to be inserted into the second insertion hole 51 for the engagement.

In the above-described embodiment, the elastically deformable portions 53 are provided on the both sides of the second insertion hole 51. However, the elastically deformable portion 53 may be provided only on either one side of the second insertion hole 51. In short, as long as a part of the second insertion hole 51 can be expanded, whether to provide the portion(s) on the both sides or either side does not matter. Accordingly, the second holding flange 32 of the second projection 30 is not limited to the arrangement in which the second holding flange 32 protrudes from the lateral surfaces of the second shaft 31 toward both sides in the width direction. The second holding flange 32 may protrude toward merely one side.

In the above-described embodiment, in the elastically deformable portion 53 of the fixing member 14, the deformable operation portion 58 is provided in a tapered shape to slope from the abutting position of the second holding flange 32 toward the second insertion hole 51. However, a tapered portion may be provided to the tip end surface of the second holding flange 32 to be inserted into the second insertion hole 51, and the tapered portion may be arranged as the deformable operation portion 58.

In the above-described embodiment, the instrument body 12 has the projections 20, 30, two of which are arranged on the front side and one on the rear while the fixing member 14 has the engaging portions 40, 50 arranged in the same manner. However, the projections and the engaging portions may be respectively arranged such that, for example, two are arranged on the front side and two on the rear. The number and the layout thereof may be appropriately changed upon the implementation of the invention.

The basic application Number JP2006-311346 upon which this patent application is based is hereby incorporated by reference.

What is claimed is:

1. A sheet attaching instrument (10) having: an instrument body (12) attached to a front surface of a sheet (1); and a fixing member (14) arranged on a back surface of the sheet (1) to fix the instrument body (12) to the sheet (1), wherein the instrument body (12) includes: a first projection (20); and a second projection (30) penetrating the sheet (1), the first projection (20) and the second projection (30) provided on a surface contacting the sheet (1) to be apart from each other, the fixing member (14) includes: a first engaging portion (40) adapted to be engaged with the first projection (20); and a second engaging portion (50) adapted to be engaged with the second projection (30), the first engaging portion (40) allowing one of the instrument body (12) and the fixing member (14) to be rotated with the first projection (20) being a support point in a direction of approaching the other, the second engaging portion (50) being engageable with the second projection (30) when the instrument body (12) and the fixing member (14) approach each other, and the second engaging portion (50) includes:

a second insertion hole (51) into which the second projection (30) is inserted, the second insertion hole (51) being engaged with the second projection (30); and an elastically deformable portion (53) that is elastically deformed in a direction in which at least a part of the second insertion hole (51) is expanded, the elastically deformable portion (53) being provided at a position at which a tip end of the second projection (30) abuts on the elastically deformable portion (53) when the instrument body (12) and the fixing member (14) are rotated, the elastically deformable portion (53) including a deformable operation portion (58) that is applied with a force in the insertion direction of the second projection (30) and deforms the elastically deformable portion (53) to expand the second insertion hole (51) on a surface of the elastically deformable portion (53) facing the sheet (1), the elastically deformable portion (53) being abutted by the tip end of the second projection (30) or the second projection (30), and in the state where the first projection (20) and the second projection (30) of the instrument body (12) are engaged with first engaging portion (40) and the second engaging portion (50) of the fixing member (14), the sliding of the instrument body (12) is restricted.

2. The sheet attaching instrument according to claim 1, wherein the first projection (20) includes a first shaft (21) and a first holding flange (22) extending from the first shaft (21) in a predetermined direction, and the second projection (31) includes: a second shaft (31) provided to be apart from the first projection (20); and a second holding flange (32) provided on the second shaft (31), the second shaft (31) being provided on a side opposite to an extending direction of the first holding flanges (22), the second holding flange (32) protruding in a direction perpendicular to the predetermined direction.

3. The sheet attaching instrument according to claim 2, wherein the second insertion hole (51) is provided between a pair of elastically deformable members of the elastically deformable portion (53) and adapted to be expanded when the elastically deformable members of the elastically deformable portion (53) are deformed in a direction to be apart from each other, the second insertion hole (51) including a projecting part (55) that protrudes from at least one of the elastically deformable members toward the other elastically deformable member of the elastically deformable portion (53), and the projecting part (55) is provided to face the second shaft (31) of the second projection (30), the projecting part (55) being provided at a surface opposite to the extending direction of the first holding flange (22).

4. The sheet attaching instrument according to claim 2, wherein the second engaging portion (50) has a second holding portion (52) around the second insertion hole (51), the second holding portion (52) adapted to hold the second holding flange (32), and the elastically deformable portion (53) is elastically deformed in a direction perpendicular to the predetermined direction, such that the insertion hole (51) is expanded.

5. The sheet attaching instrument according to claim 1, wherein the deformable operation portion (58) is provided in a tapered shape to slope toward the second insertion hole (51) on the elastically deformable portion (53).

6. The sheet attaching instrument according to claim 1, wherein the deformable operation portion (58) is provided by a tapered portion to be inserted into the second insertion hole (51) provided to a tip end of the second projection (30).

* * * * *

UNITED STATES PATENT AND TRADEMARK OFFICE

CERTIFICATE OF CORRECTION

PATENT NO. : 7,954,212 B2
APPLICATION NO. : 11/978746
DATED : June 7, 2011
INVENTOR(S) : Funo et al.

It is certified that error appears in the above-identified patent and that said Letters Patent is hereby corrected as shown below:

Column 12

Line 6, "(31)" should read --(30)-- (first occurrence)

Signed and Sealed this
Twentieth Day of December, 2011

David J. Kappos

David J. Kappos
*Director of the United States Patent and Trademark Office*